US006149336A

United States Patent [19]

Bartley et al.

[11] Patent Number: 6,149,336

[45] Date of Patent: Nov. 21, 2000

[54] COMPLIANT CONNECTOR

[75] Inventors: Robert Michael Bartley, Ravenna; Jay Harold Garretson, Warren, both of Ohio

[73] Assignee: General Motors Corporation, Detroit, Mich.

[21] Appl. No.: 09/086,906

[22] Filed: May 29, 1998

[51] Int. Cl.[7] ..... F02P 3/02

[52] U.S. Cl. ..... 403/14; 403/366; 123/169 PA; 123/635

[58] Field of Search ..... 403/12, 13, 14, 403/365, 366, 372, 220, 359.4, 297; 123/435, 673, 169 PA, 169 P, 154, 635

[56] References Cited

U.S. PATENT DOCUMENTS 3,314,699 4/1967 Taylor ..... 403/14
4,903,675 2/1990 Huntzinger et al. ..... 123/635
5,060,624 10/1991 Bruning et al. ..... 123/635
5,125,386 6/1992 De Filippis et al. ..... 123/635
5,146,906 9/1992 Agatsuma ..... 123/635
5,152,274 10/1992 Maekawa ..... 123/635
5,682,865 11/1997 Maekawa et al. ..... 123/635
5,842,458 12/1998 Alstrin et al. ..... 123/169 PA X

*Primary Examiner*—Lynne H. Browne
*Assistant Examiner*—David E. Bochna
*Attorney, Agent, or Firm*—Richard A. Jones

[57] ABSTRACT

A compliant connector for a connection system in an internal combustion engine includes a cylindrical connector housing and a plurality of constant strain beam springs at one end of the connector housing to act as a self-centering/self-aligning mechanism in the connection system.

14 Claims, 3 Drawing Sheets

COMPLIANT CONNECTOR

TECHNICAL FIELD

The present invention relates generally to connectors for engines and, more particularly, to a compliant connector for a connection system in an internal combustion engine.

BACKGROUND OF THE INVENTION

It is known to provide a sensor to sense pressure in a combustion chamber for a cylinder of an internal combustion engine. The sensor is typically of a strain gage type that can also detect cylinder misfires and knock and can advance or retard ignition timing accordingly. It is also known to provide a signal level connection system between the sensors (one for each cylinder) and an electronic controller. The controller monitors the combustion process through the sensor and adjusts the ignition timing to the proper level.

Typically, the connection system includes a rigid frame with a plurality of fixed connector housings, electrical contacts, upper body seals, inserts and a cover plate. The connection system is assembled to the sensors and secured to the engine. The primary function of the connection system is to maintain an electrical connection to the sensors and the controller. Other functions of the connection system are to seal out dust and fluids, EMI protection from the primary ignition source, and compatibility with coil or plug applications.

Although the connection system has worked well, the manufacturing tolerance variation in sensor pockets in the engine may produce unequal pressure on the seals which could permit dust and moisture to enter the connection system. The connection system may also experience high engagement during the assembly process. Off center engagement could also cause the seals to tear, thus rendering the seals ineffective. Also, normal engine vibrations may permit micro motion between the electrical contacts and the sensor contacts. This micro motion may be responsible for fretting and wear on terminal contacts. Therefore, there is a need in the art to provide a connector for a connection system in an internal combustion engine which accommodates for manufacturing tolerances and seals out foreign contaminants.

SUMMARY OF THE INVENTION

Accordingly, the present invention is a compliant connector for a connection system in an internal combustion engine. The compliant connector includes a cylindrical connector housing and a plurality of constant strain beam springs on one end of the connector housing to act as a self-centering/self-aligning mechanism in the connection system.

One advantage of the present invention is that a compliant connector is provided for a connection system in an internal combustion engine. Another advantage of the present invention is that the compliant connector is self-centering/self-aligning and accommodates manufacturing tolerances of devices that are rigidly supported. Yet another advantage of the present invention is that the complaint connector has three constant strain beam springs which act as the self-aligning mechanism. Still another advantage of the present invention is that the compliant connector maintains a uniform pressure on the sealing surfaces to effectively maintain adequate sealing pressure and to seal out moisture and foreign contaminants from the connection system. A further advantage of the present invention is that electrical performance of the connection system is maintained. Yet a further advantage of the present invention is that the compliant connector is a cost effective solution for the disadvantages of conventional connection systems.

Other features and advantages of the present invention will be readily appreciated as the same becomes better understood after reading the subsequent description when considered in connection with the accompanying drawings.

DESCRIPTION OF THE PREFERRED EMBODIMENT

Figure 1:
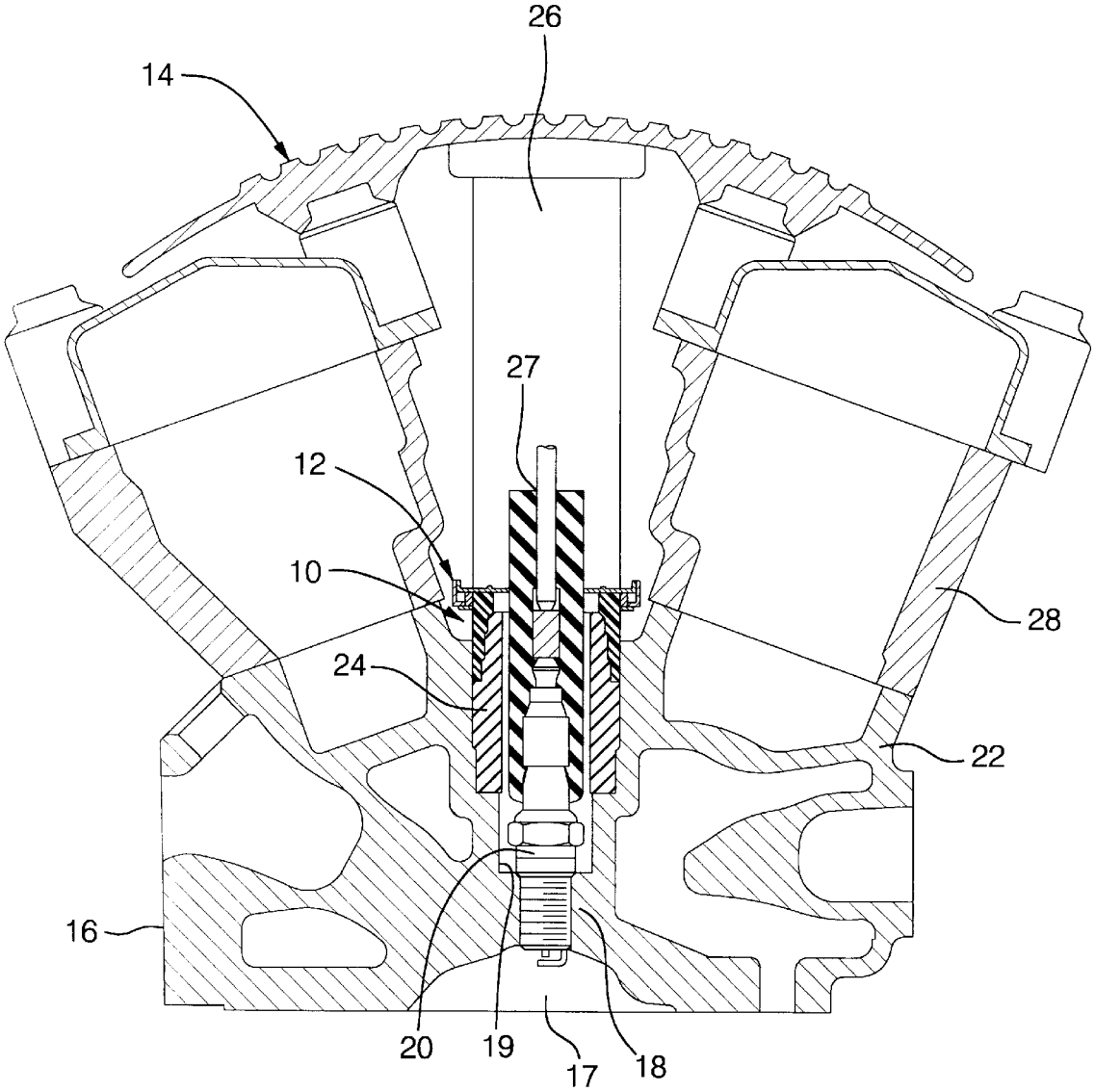
FIG. 1 is an elevational view of a compliant connector for a connection system, according to the present invention, illustrated in operational relationship with an internal combustion engine.
Figure 2:
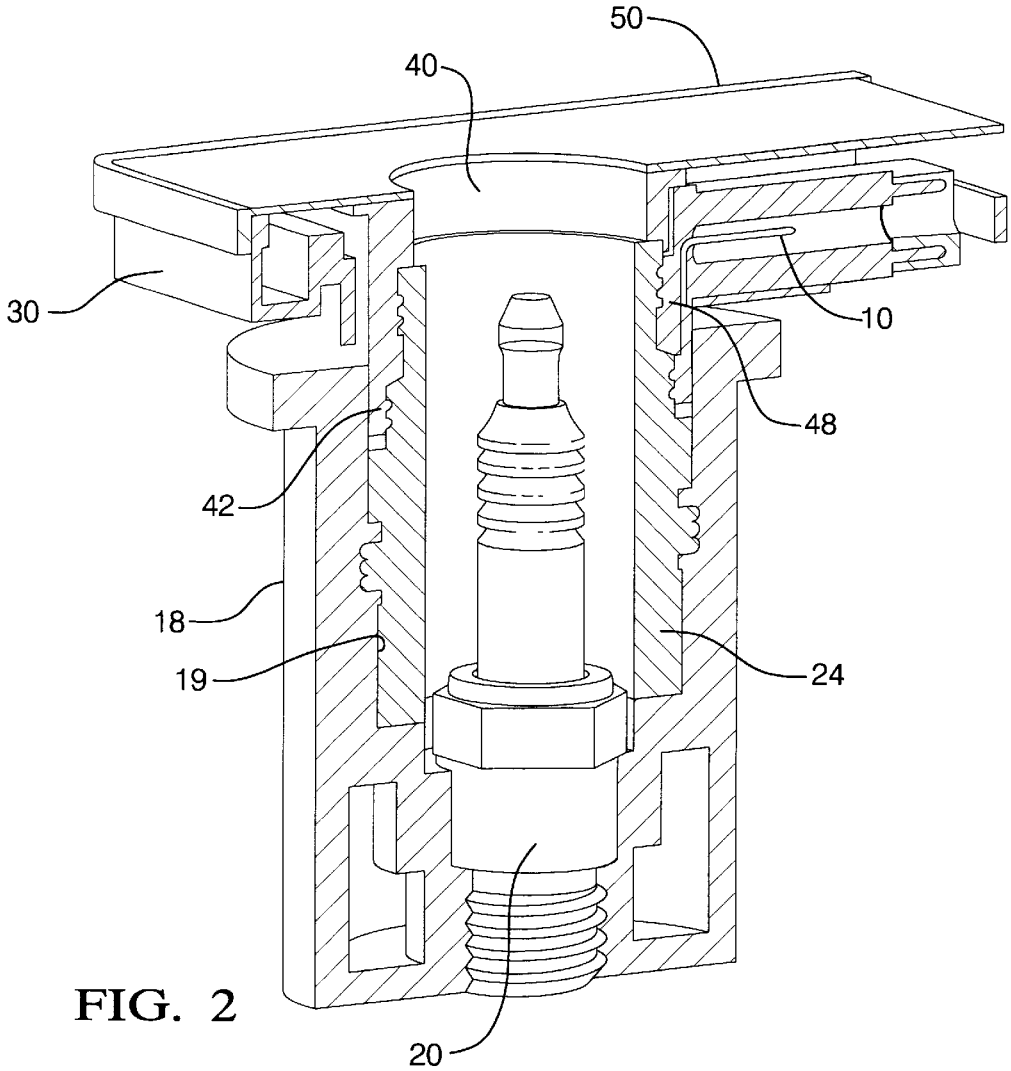
FIG. 2 is a fragmentary perspective view of the compliant connector, connection system and internal combustion engine of FIG. 1.
Figure 4:
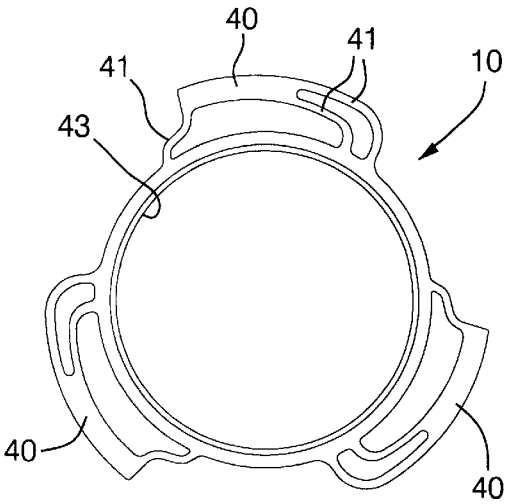
FIG. 4 is a plan view of the complaint connector of FIG. 3.
Figure 5:
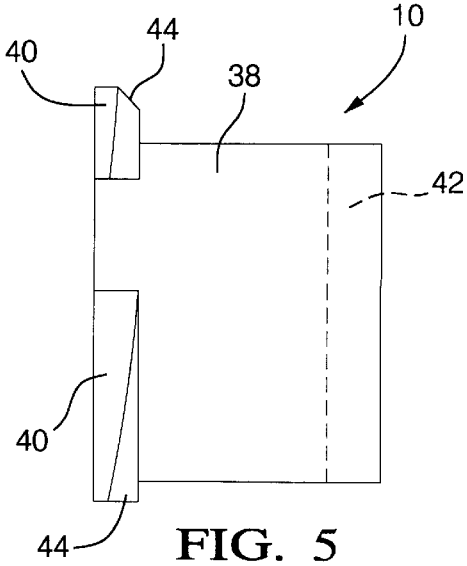
FIG. 5 is an elevational view of the complaint connector of FIG. 3.
Figure 3:
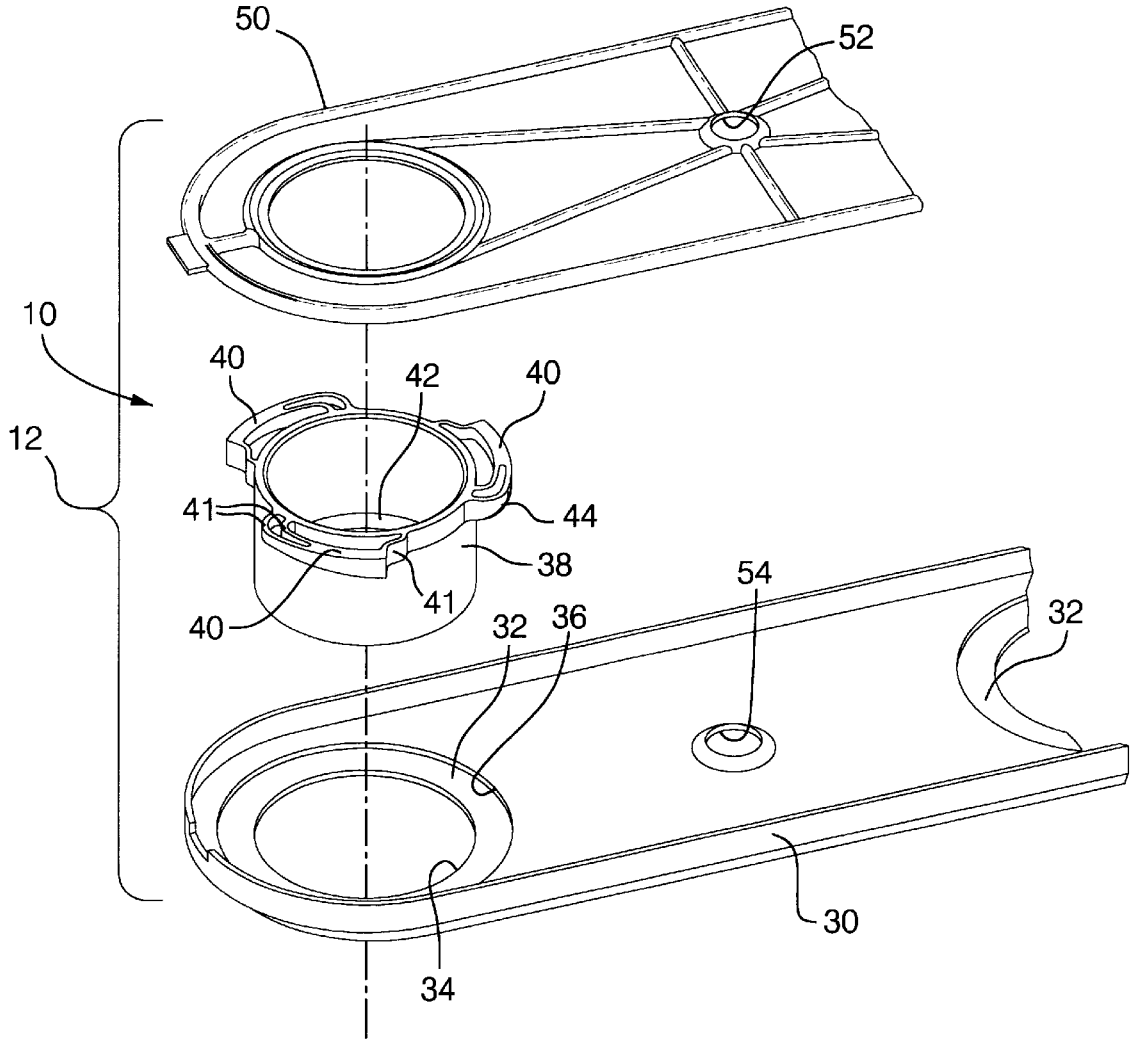
FIG. 3 is an exploded view of the complaint connector and a portion of the connection system of FIG. 1.

Referring to FIGS. 1 and 2, a complaint connector 10, according to the present invention, for a connection system, generally indicated at 12, is illustrated in operational relationship with an engine, generally indicated at 14, such as an internal combustion engine. The engine 14 includes an engine block 16 such as an engine head having a combustion chamber 17. The engine block 16 is a machined metal structure having a spark plug boss 18 forming a well or pocket 19. The engine 14 includes a spark plug 20 disposed within the pocket 19. The engine 14 also has an upper deck 22 extending from the spark plug boss 18. The engine 14 includes a cylinder pressure sensor 24 threadably engaged into the pocket 19 in a surrounding relationship to the spark plug 20. The sensor 24 is a piezoelectric type strain gage that can be calibrated to detect pressure in the combustion chamber 17 prior to actual combustion of a volatile gas/air mixture. An example of such a sensor is disclosed in U.S. Pat. No. 5,823,802 issued Oct. 20, 1998 and assigned to the assignee of the present application, entitled "ELECTRICAL CONNECTOR WITH COMBINATION SEAL AND CONTACT MEMBER", the disclosure of which is hereby incorporated by reference. It should be appreciated that the sensor 24 is conventional and known in the art.

The engine 14 further includes the connection system 12, according to the present invention, connected to the sensor 24 and an electronic controller (not shown) such as an engine controller. The engine 14 includes an ignition module 26 having a spark plug connector 27 attached to the spark plug 20 and contacting the connecting system 12. The engine 14 includes a non-integrated cam carrier 28 connected to the upper deck 22 for enclosing the ignition module 26. It should be appreciated that, except for the compliant connector 10 and connection system 12, the engine 14 is conventional and known in the art.

The connection system 12 includes a compliant connector module or carrier frame 30 having at least one pocket 32 with an aperture 34 extending therethrough. The pocket 32 has a lead-in chamfer 36. The carrier frame 30 extends longitudinally and is modular to accommodate a plurality of pockets 32, preferably three to five pockets 32. Preferably, the carrier frame 30 is injection molded of a rigid material such as plastic. The carrier frame 30 also has a connector shroud (not shown) at one end to provide an interconnect to the controller.

Referring to FIGS. 1 through 4, the connection system 12 includes the compliant connector 10 that fits onto an upper portion of the sensor 24. The compliant connector 10 has a cylindrical connector housing 38 with a generally circular shape. The connector housing 38 is made of a rigid material such as plastic. The compliant connector 10 also includes a plurality of, preferably three, arcuate or curved constant strain beam springs 40 on one end that act as alignment springs. The springs 40 are spaced circumferentially about the connector housing 38 and have flanges 41 connecting it to the connector housing 38 to allow the springs 40 to flex or depress radially relative to the connector housing 38. The springs 40 are made of a plastic molded to the connector housing 38. The compliant connector 10 also has a lower body seal 42 co-molded to the plastic of the connector housing 38. The lower body seal 42 is made of a silicone material. The lower body seal 42 is a ring that has a plurality of axially spaced flexible circumferential sealing lips that biasingly engage an outer surface of the sensor 24. The curved springs 40 on the connector housing 38 have a chamfer 44 at a lower edge thereof. It should be appreciated that the connector housing 38 and springs 40 are integral, unitary and formed as onepiece.

The connection system 12 also includes an insert 46 disposed within the connector housing 38 of the compliant connector 10. The insert 46 aligns with a cover 50 to be described and provides EMI protection from the spark plug 20, termination and wiring. It should be appreciated that the insert 46 is conventional and known in the art.

The connection system 12 also includes an upper body seal 48 inserted into the connector housing 38 of the compliant connector 10. The upper body seal 48 is a tubular member molded of a flexible elastomeric material such as silicone rubber. The upper body seal 48 has a plurality of axially spaced flexible circumferential sealing lips that biasingly engage an outer surface of the sensor 24 and prevents moisture and dust from contaminating the electrical interior. The connection system 12 includes a terminal (not shown) inserted into the connector housing 38 of the compliant connector 10. The terminal may be either a flexible printed circuit or metallic termination. The terminations are connected by either IDC, flexible printed circuit or conventional wiring. It should be appreciated that the upper body seal 48 and terminal are conventional and known in the art.

The connection system 12 further includes an umbrella cover 50 to engage the insert 46 and provide a top cover for the frame 30. The cover 50 is made of a rigid material such as stainless steel to shield the connection system 12 from ignition sources that are generated from a primary coil (not shown) located above the sensors 24. The cover 50 is assembled onto the top of the frame 30 via snap locks or heat staking and will contact the sensor shield. The frame 30 and cover 50 are secured to the engine block 16 by suitable fasteners such as bolts (not shown) which extend through apertures 52 and 54 in the cover 50 and frame 30, respectively, and provide a ground path for noise generated by the ignition module 26.

To assemble the connection system 12, the connector housing 38 is disposed into the pocket 32 of the frame 30. The connector housing 38 is inserted into the pocket 32 such that the springs 40 will flex or depress slightly toward the connector housing 38. The springs 40 and pockets 32 have matching chambers 36 and 44 such that during the engagement of the connector housing 38 in the frame 30, the springs 40 deflect toward the connector housing 38. In place, the final fit is semi-rigid and slightly preloaded to produce a self-centered, rattle free connection. A terminal is inserted into each housing 38. The upper body seals and inserts are inserted into each connector housing 38. The terminals are then connected. The cover 50 is assembled on the top of the frame 30. The complete module of the connection system 12 is inserted into the pocket 19 of the engine block 16 and join 3, 4 or 5 sensors 24. The connection system 12 is secured in place by bolts through apertures 52 and 54 in the cover 50 and frame 30, locking the compliant connector 10 into the desired position. Since the initial engagement aligned the compliant connector 10, insert, and seals to the fixed sensor 24, the bolting action captures and secures the position and retains the compliant connector 10 within the frame 30 centered on the sensor 24. It should be appreciated that the bolts act as a ground path for unwanted H and E field intensities generated by the spark plug 20 that the compliant connector 10 encompasses.

Accordingly, the compliant connector 10 floats to balance the loading on the seals within the connector housing 38 due to the manufacturing tolerances for the sensors 24. The springs 40 deflect to permit the compliant connector 10 to move within the frame 30 during insertion to the sensors 24. The compliant connectors 10 become fixed during the final attachment of the connection system 12 to the engine block 16. As a result, the connection system 12 maintains seal integrity on both upper and lower body seals, is modular and provides EMI protection.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A compliant connector for a connection system in an internal combustion engine comprising:

a cylindrical connector housing extending axially; and a plurality of constant strain beam springs spaced circumferentially on one end of said connector housing, said springs being spaced radially from and connected to said connector housing to allow said springs to flex radially relative to said connector housing to act as a self-centering/self-aligning mechanism in the connection system, and a lower body seal co-molded to said connector housing, the lower body seal being made of a silicone material.

2. A connection system for connection to at least one sensor in an internal combustion engine comprising:

a frame having at least one pocket and an aperture extending therethrough; and at least one compliant connector having a connector housing disposed in said at least one pocket and having a plurality of constant strain beam springs, said springs being spaced radially from and connected to said connector housing by a plurality of flanges to allow said springs to flex radially relative to said connector housing to self-center/self-align said connector within said pocket.

3. A connection system as set forth in claim 2 wherein said at least one compliant connector comprises a cylindrical connector housing and said springs are disposed on one end of said connector housing.

4. A connection system as set forth in claim 3 wherein said connector housing is circular in shape.

5. A connection system as set forth in claim 3 wherein said connector housing and said springs are integral, unitary and formed as one-piece.

6. A connection system as set forth in claim 3 wherein said compliant connector is made of a plastic material.

7. A connection system as set forth in claim 3 including a lower body seal co-molded to said connector housing.

8. A connection system as set forth in claim 7 wherein said lower body seal is made of a silicone material.

9. A connection system as set forth in claim 2 wherein each of said springs have a lead-in chamfer thereon.

10. A connection system as set forth in claim 9 wherein said pocket includes a chamfer to mate with said lead-in chamfer.

11. A connection system as set forth in claim 2 including a cover attached to said frame.

12. A connection system as set forth in claim 11 wherein said cover is made of stainless steel.

13. A connection system for connection to at least one sensor in an internal combustion engine comprising:

a frame having at least one pocket and an aperture extending therethrough;

at least one compliant connector having a connector housing disposed in said at least one pocket and having a plurality of constant strain beam springs, said springs being spaced radially from and connected to said connector housing by a plurality of flanges to allow said springs to flex radially relative to said connector housing to act as a self-centering/self-aligning mechanism in the connection system, each of said springs having a lead-in chamfer thereon and said at least one pocket having a chamfer to mate with said lead-in chamfer to self-center/self-align said complaint connector within said pocket; and a cover attached to said frame.

14. A connection system as set forth in claim 13 wherein said connector housing and said springs are integral, unitary and formed as one piece.

* * * * *